US008572779B2

(12) United States Patent
Pratt et al.

(10) Patent No.: US 8,572,779 B2
(45) Date of Patent: Nov. 5, 2013

(54) EXPANDABLE PILLOW

(75) Inventors: Janice Pratt, Seattle, WA (US); André Marie Cabrera, Woodinville, WA (US)

(73) Assignee: Pacific Coast Feather Company, Seattle, WA (US)

( * ) Notice: Subject to any disclaimer, the term of this patent is extended or adjusted under 35 U.S.C. 154(b) by 0 days.

(21) Appl. No.: 13/107,617

(22) Filed: May 13, 2011

(65) Prior Publication Data

US 2012/0284924 A1 Nov. 15, 2012

(51) Int. Cl.
*A47G 9/10* (2006.01)

(52) U.S. Cl.
USPC ..... 5/636; 5/645; 5/640; 5/652

(58) Field of Classification Search
USPC ..... 5/630, 636, 639, 645, 640, 420, 652
See application file for complete search history.

(56) References Cited

U.S. PATENT DOCUMENTS

| | | | | |
|---|---|---|---|---|
| 2,805,428 | A * | 9/1957 | Buchman | 5/645 |
| 3,299,451 | A | 1/1967 | Trogdon | |
| 5,271,114 | A | 12/1993 | Kjersem | |
| 6,347,421 | B1 | 2/2002 | D-Emilio | |
| 6,532,611 | B1 | 3/2003 | Day | |
| 6,691,352 | B2 | 2/2004 | Wang | |
| 6,760,935 | B1 * | 7/2004 | Burton et al. | 5/645 |
| 6,988,286 | B2 * | 1/2006 | Schecter et al. | 5/645 |
| 8,028,360 | B2 * | 10/2011 | Regan et al. | 5/645 |
| 2004/0019972 | A1 * | 2/2004 | Schecter et al. | 5/645 |
| 2004/0068795 | A1 * | 4/2004 | Hollander | 5/502 |
| 2005/0235423 | A1 * | 10/2005 | Hetzel et al. | 5/653 |
| 2008/0098528 | A1 * | 5/2008 | Delfs | 5/645 |
| 2008/0235877 | A1 | 10/2008 | Murray | |
| 2009/0106904 | A1 * | 4/2009 | Swarts et al. | 5/636 |
| 2009/0235459 | A1 | 9/2009 | Tidwell et al. | |
| 2011/0290834 | A1 * | 12/2011 | Pelz et al. | 224/259 |
| 2012/0079659 | A1 * | 4/2012 | Loos | 5/636 |

* cited by examiner

*Primary Examiner* — William Kelleher
(74) *Attorney, Agent, or Firm* — Jensen & Puntigam, P.S.

(57) ABSTRACT

The pillow includes upper and lower substantially identical fabric sections, each having a peripheral edge with a gusset extending therebetween. A zipper assembly includes a gusset zipper portion and a pillow zipper portion which extends around substantially the entire periphery of the pillow from the end of the gusset zipper portion to a terminating point just before the end of the gusset zipper portion.

8 Claims, 2 Drawing Sheets

EXPANDABLE PILLOW

TECHNICAL FIELD

This invention relates generally to a bed pillow which is expandable between three configurations, and more specifically concerns a pillow which is expandable between a traditional pillow configuration with a single peripheral edge, a gusseted configuration with a gusset between two spaced peripheral edges and a wedge configuration.

BACKGROUND OF THE INVENTION

Pillows having various exterior configurations are well known. A traditional bed pillow is rectangular, with a single peripheral edge joining upper and lower fabric sections. An alternative configuration includes two upper and lower fabric sections, each of which has a peripheral edge, with a gusset between the upper and lower peripheral edges. Other shapes, including square, oval and even circular are possible. Specialty pillows, such as for specific neck and/or head support are also known. A wedge-shaped pillow is an example of a special pillow configuration.

Both traditional and gusseted bed pillows and wedge pillows have separate desirable features. Up until now, it was necessary to buy two pillows if one wanted both the traditional and the gusset pillows. Two separate pillows, however, require additional expense and possibly storage if both pillows are not used at the same time. The same is true for a wedge pillow.

DISCLOSURE OF THE INVENTION

Accordingly, the expandable pillow comprises: an upper fabric section having a peripheral edge; a lower fabric section having a peripheral edge; a gusset section joining the upper and lower fabric sections around the peripheral edges thereof; and a zipper assembly, comprising a gusset zipper portion, a peripheral edge zipper portion, and a slider member, wherein the gusset zipper portion extends from a selected start point along one side of the pillow and extends a selected distance to the peripheral edges of the upper and lower fabric sections, the peripheral edge zipper portion extending from a distal end of the gusset zipper portion around the peripheries of the upper and lower fabric sections, joining the peripheral edges thereof together, and terminating at a point just before a start point of the peripheral edge zipper portion, wherein the pillow is in a gusseted configuration when the zipper assembly is open and in a conventional configuration, with the peripheral edges of the upper and lower fabric sections joined together, when the zipper assembly is closed.

BEST MODE FOR CARRYING OUT THE INVENTION

Figure 1:
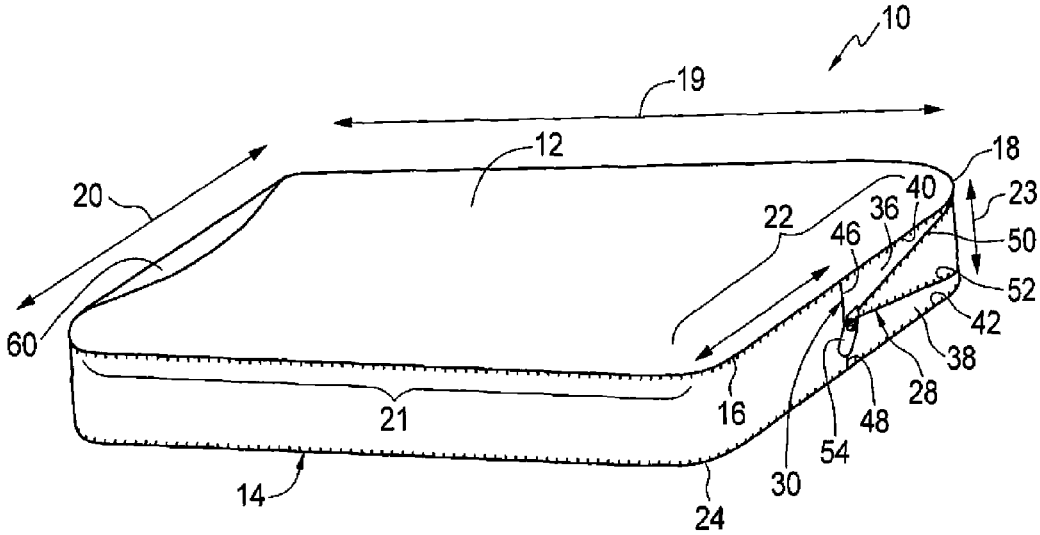
FIG. 1 is a perspective view of the expandable pillow in a gusseted configuration, showing the zipper arrangement for converting the pillow between a traditional and a gusseted configuration, as well as a wedge-shaped pillow.

Pillow 10 In FIG. 1 includes an upper fabric section 12 and a lower fabric section 14 which are substantially identical in size and configuration. The upper fabric section 12 has a one-half zipper teeth set 16 at the peripheral edge thereof, extending from corner 18 along longitudinal side 19, lateral side 20, longitudinal side 21 and most of lateral side 22, terminating just before corner 18. The lower fabric section 14 includes a one-half zipper teeth set 24 around its peripheral edge, terminating just before corner 18, like zipper teeth set 16. A gusset 23 is attached to and extends between the upper and lower fabric sections, respectively, slightly inboard from the zipper teeth sets 16 and 24.

The upper and lower fabric sections may have various configurations and sizes, including rectangular, which is shown in FIG. 1. However, other configurations can be used. The fabric sections may be made of various materials, including cotton and polyester, among others. The same fabric can be used for gusset 23 or a different fabric can be used, including stretchable fabric. The upper and lower fabric sections and the gusset can also have various dimensions. In one example, a queen size gusseted pillow has a length of 28 inches, a width of 18 inches and a 2 inch gusset, although the gusset size can vary.

FIG. 1 shows the complete zipper arrangement for the expandable pillow which includes a gusset zipper portion 28. The gusset zipper portion 28 extends from a seam 30 located approximately midway of lateral edge 22. The gusset zipper portion 28 includes two opposing sections of zipper tape 36 and 38, each of which has a longitudinal edge, 40 and 42, respectively, sewn into the peripheral edge of the upper and lower fabric sections, respectively, with proximal ends 46 and 48 sewn to the seam 30. Each zipper tape section 36, 38 has a triangular configuration, with the angled edges each having a set of zipper teeth 50, 52. A slider 54 is positioned, when the zipper is in its open configuration, approximately at the seam 30, joining the two sets of zipper teeth 50 and 52. The gusset zipper portion 28 extends to the peripheral edges of the upper and lower fabric sections approximately at the corner 18.

Figure 2:
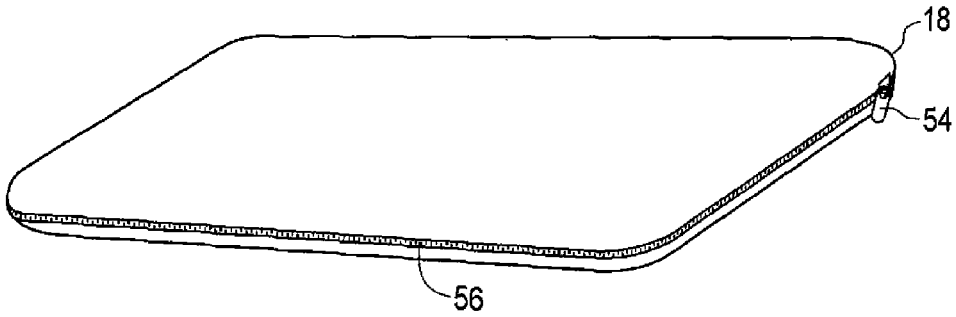
FIG. 2 is a perspective view showing just the zipper of the pillow of FIG. 1 in a closed configuration to form a traditional pillow.

FIG. 1 shows the zipper arrangement in an open position, so that the pillow in its gusseted configuration. When the pillow is to be changed to a traditional configuration, slider 54 is pulled from its open position adjacent seam 30, pulling/joining the two zipper teeth sets 50, 52 together, along with the peripheral edges of the upper and lower fabric sections gradually toward each other, until corner 18 is reached. The zipper teeth sets 50, 52 at the corner 18 continue as the start of zipper teeth sets 16 and 24, with the peripheral edges of the upper and lower fabric sections coming together at corner 18. The slider 54 is then further pulled, joining the two zipper teeth sets 16, 24 of the fabric sections along longitudinal edge 19, lateral edge 20, longitudinal edge 21 and then lateral edge 22, until the zipper teeth terminate just short of corner 18. FIG. 2 shows closed zipper 56 and slider 54 in the closed configuration, with the slider 54 positioned just short of corner 18. The pillow 10 is now in its traditional configuration, with a single (joined) peripheral edge.

The zipper arrangement shown and described above provides a convenient and reliable yet simple arrangement for changing the configuration of a pillow from a traditional configuration to a gusset configuration. The zipper arrangement can also be used to make a wedge configuration for the pillow by zipping the gusset zipper the entire longitudinal edge 19 and one-half of lateral edge 20.

Along lateral edge 20 is an opening 60 between the upper fabric section and the gusset section, having a length of the lateral edge minus one-half inch to permit blow-in of fill, either natural fill such as feather and/or down, or polyester fill, or a combination thereof.

Figure 3:
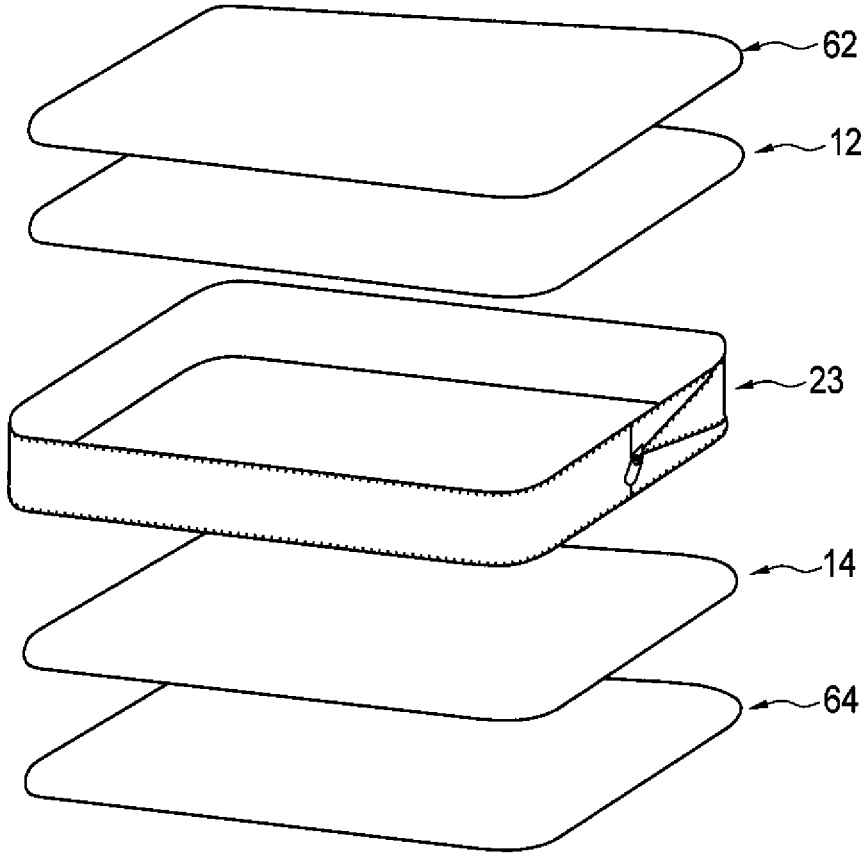
FIG. 3 is an exploded view showing the pillow of FIGS. 1 and 2 in a gusseted configuration with additional outer fabric sections, defining chambers with fill between the outer fabric sections and the upper and lower fabric sections.

FIG. 3 is an exploded view of the pillow of FIGS. 1 and 2 with added outer fabric layers 62 and 64 which are secured, respectively, to the peripheral edges of the upper and lower fabric layers 12 and 14, with intermediate gusset 23. The securement is just inboard of the zipper teeth on the upper and lower fabric sections. Fill, either feathers and/or down, or polyester, is blown in between the upper and lower fabric sections, respectively and the outer fabric sections. This results in an expandable pillow within a pillow arrangement.

Although a preferred embodiment of the invention has been disclosed for purposes of illustration, it should be understood that various changes, modifications and substitutions may be incorporated in the embodiment without departing from the spirit of the invention, which is defined by the claims which follow.

What is claimed is:

1. An expandable pillow, comprising:

an upper fabric section having a peripheral edge;

a lower fabric section having a peripheral edge;

a gusset section joining the upper and lower fabric sections around the peripheral edges thereof; and a zipper assembly, comprising a gusset zipper portion, a peripheral edge zipper portion, and a slider member, wherein the gusset zipper portion extends from a selected start point along one side of the pillow and extends a selected distance to the peripheral edges of the upper and lower fabric sections, the peripheral edge zipper portion extending from a distal end of the gusset zipper portion around the peripheries of the upper and lower fabric sections, joining the peripheral edges thereof together, and terminating at a point just before a start point of the peripheral edge zipper portion, wherein the pillow is in a gusseted configuration when the zipper assembly is open and in a conventional configuration, with the peripheral edges of the upper and lower fabric sections joined together, when the zipper assembly is closed.

2. The expandable pillow of claim 1, wherein the gusset zipper portion extends from a seam approximately midway of a lateral edge of the pillow to an adjacent corner of the pillow, wherein the upper and lower fabric sections are joined at their peripheral edges initially at said corner, and then continue around the pillow until a point just before said corner.

3. The expandable pillow of claim 1, wherein the pillow is substantially rectangular and the gusset is approximately two inches high.

4. The expandable pillow of claim 1, including a closeable opening between one of the upper and lower fabric sections and the gusset for insertion of fill, the fill being natural fill or polyester or a combination thereof.

5. The expandable pillow of claim 2, wherein the zipper assembly is so arranged and the gusset is so configured, that when the pillow is zipped from one lateral side to a selected point on an opposing lateral side, the pillow has a wedge configuration.

6. The expandable pillow of claim 1, includes first and second outer fabric sections secured to the upper and lower fabric sections around the peripheries thereof and fill between the upper and lower fabric sections, respectively and the first and second outer fabric sections.

7. An expandable pillow, comprising:

an upper fabric section having a peripheral edge;

a lower fabric section having a peripheral edge, the upper and lower fabric sections being substantially identical in size and configuration;

a gusset which extends between the peripheral edges of the upper and lower fabric sections; and a zipper assembly which extends from a selected point along one side of the pillow and is arranged to gradually draw the peripheral edges of the upper and lower fabric sections toward each other, until they come together at a joining point, the zipper assembly being further arranged to join said peripheral edges from the joining point further in one direction around the periphery of the pillow to a terminating point past the selected point, just before the joining point, thus extending the joining of the peripheral edges of the upper and lower fabric sections by the single zipper assembly around at least almost the entire periphery of the pillow, wherein the pillow is in a gusseted configuration when the zipper assembly is open and in a conventional configuration, with the peripheral edges of the upper and lower fabric sections joined together, when the zipper assembly is closed.

8. The zipper assembly of claim 7, wherein the joining point is a corner of the pillow.

* * * * *